US008191328B1

(12) United States Patent
Liu

(10) Patent No.: US 8,191,328 B1
(45) Date of Patent: Jun. 5, 2012

(54) HARDWOOD FLOORING WITH SLIDING LOCKING MECHANISM

(76) Inventor: David C. Liu, Marietta, GA (US)

( * ) Notice: Subject to any disclaimer, the term of this patent is extended or adjusted under 35 U.S.C. 154(b) by 0 days.

(21) Appl. No.: 13/021,081

(22) Filed: Feb. 4, 2011

(51) Int. Cl.

| | |
|---|---|
| ***E04B 2/00*** | (2006.01) |
| ***E04C 3/00*** | (2006.01) |
| ***E04D 1/00*** | (2006.01) |
| ***E04F 13/08*** | (2006.01) |

(52) U.S. Cl. ..... 52/588.1; 52/578; 52/390; 52/392; 52/533; 52/534; 52/539; 52/582.1; 52/591.3; 52/591.1; 52/591.2

(58) Field of Classification Search ..... 52/578, 52/588.1, 390, 392, 533, 534, 539, 553, 582.1, 52/596.1, 586.2, 589.1, 590.2, 590.3, 591.1–591.5, 52/592.1, 582.2, 582.4
See application file for complete search history.

(56) References Cited

U.S. PATENT DOCUMENTS

| | | | | |
|---|---|---|---|---|
| 4,242,390 | A * | 12/1980 | Nemeth | 428/47 |
| 4,796,402 | A * | 1/1989 | Pajala | 52/390 |
| 5,906,082 | A * | 5/1999 | Counihan | 52/403.1 |
| 6,021,615 | A * | 2/2000 | Brown | 52/392 |
| 6,182,413 | B1 * | 2/2001 | Magnusson | 52/589.1 |
| 7,188,456 | B2 * | 3/2007 | Knauseder | 52/592.1 |
| 7,225,591 | B2 * | 6/2007 | Lin et al. | 52/403.1 |
| 7,805,903 | B2 * | 10/2010 | Liu | 52/489.1 |
| 8,029,880 | B2 * | 10/2011 | Liu | 428/60 |
| 2004/0211143 | A1 * | 10/2004 | Hanning | 52/578 |
| 2005/0102937 | A1 * | 5/2005 | Pervan | 52/283 |
| 2006/0096223 | A1 * | 5/2006 | Kyoung Taek | 52/578 |
| 2007/0163194 | A1 * | 7/2007 | Stone | 52/309.8 |
| 2007/0175137 | A1 * | 8/2007 | Stone et al. | 52/295 |
| 2008/0000182 | A1 * | 1/2008 | Pervan | 52/478 |
| 2008/0005992 | A1 * | 1/2008 | Pervan | 52/478 |
| 2008/0028707 | A1 * | 2/2008 | Pervan | 52/391 |
| 2009/0151291 | A1 * | 6/2009 | Pervan | 52/592.1 |
| 2010/0229491 | A1 * | 9/2010 | Pervan | 52/588.1 |

* cited by examiner

*Primary Examiner* — Mark Wendell
(74) *Attorney, Agent, or Firm* — Wang Law Firm, Inc.; Li K. Wang

(57) ABSTRACT

A hardwood floor with a flexible locking mechanism is disclosed. The floor board has a male locking apparatus on one end and a female locking apparatus on the opposite end. Two adjacent floor boards are engaged by sliding the male locking apparatus of one floor board into the female locking apparatus of an adjacent floor board. The female locking apparatus includes a flexible lower lip that moves downward when the male locking apparatus engages the female locking apparatus.

13 Claims, 5 Drawing Sheets

HARDWOOD FLOORING WITH SLIDING LOCKING MECHANISM

FIELD OF THE INVENTION

The invention relates to wood flooring, and more particularly, to flooring boards with horizontal locking mechanism.

BACKGROUND OF THE INVENTION

Traditional floor boards are installed via nail down or glue down methods. Recently, floor boards can be installed via floating method with mechanical locks. Most of these mechanical locks are based on a mechanism of flipping down on one edge to lock and sliding into another edge to secure the entire board. The locks require precision milling for the locks to work properly and small deformation of flooring panel after milling will render the locks unusable. This deformation makes these locks difficult to apply to solid hardwood floor where possible deformation is much larger than the deformation for laminate or engineered floor.

Most of mechanical locks could not apply to thin floor, especially thin solid wood floor. This is because wood grooves with the locks are too thin and easily to crack or break, especially as it getting thinner.

Therefore, there is a need for a locking mechanism that accepts deformation of floor boards, especially thin floor boards. It is to this apparatus the present invention is primarily directed to.

SUMMARY OF THE INVENTION

The present invention provides a floor board with a sliding locking mechanism. The floor board includes a body with two opposite ends. One end has a male locking mechanism and another end has a female locking mechanism. The female locking mechanism is formed by an upper lip and a receiving channel. The male locking mechanism is formed by a tongue and a recessed region. The floor board has a lower slate attached to its body and the lower slate moves downwardly when the male locking apparatus slides laterally into the female locking apparatus.

The floor boards of the present invention is therefore advantageous as they enable two adjacent floor boards to be engaged by sliding laterally one floor board into an adjacent floor board. Other advantages and features of the present invention will become apparent after review of the hereinafter set forth Brief Description of the Drawings, Detailed Description of the Invention, and the Claims.

BRIEF DESCRIPTION OF THE DRAWINGS

Features and advantages of embodiments of the invention will become apparent as the following Detailed Description proceeds, and upon reference to the Drawings, where like numerals depict like elements, and in which.

DETAILED DESCRIPTION OF THE INVENTION

Figure 1A:
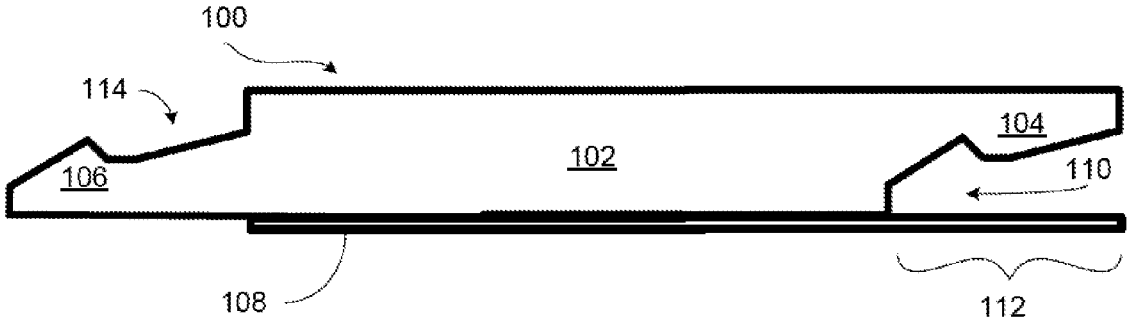
FIG. 1A illustrates a floor board with a sliding locking mechanism according to one embodiment of the invention.

The present invention provides a sliding locking system for floor boards. FIG. 1A depicts one floor board according to one embodiment of the present invention. The floor board 100 has a body 102 with two opposite ends. One end has a male locking apparatus, which includes a tongue 106 and a recessed region 114, and another end has a female locking apparatus, which includes an upper lip 104 and a receiving channel 110. The floor board 100 also has a lower slate 108 that covers most of the lower surface of the body 102. The lower slate 108 extends beyond the lower surface of the body 102 and forms a lower lip 112. The lower lip 112 opposes the upper lip 104 and forms the receiving channel 110 with the upper lip 104. The tongue 106 extends beyond the lower slate 108. The body 102 can be made from solid wood, composite wood, or other man-made material. The body 102 may include a thin top layer (not shown) that provides wood appearance for decorative effect. The lower slate 108 may be integral part of the body 102 of the floor board or may be a separate piece and attached to the body 102. The lower slate 108 may be made from the same material as the body 102 or may also be made from different material and then attached to the body 102 with glue, nail, screw, or other attaching means (not shown). The lower slate 108 preferably is flexible so that it can be bent without breaking and returns to its original position.

Figure 1B:
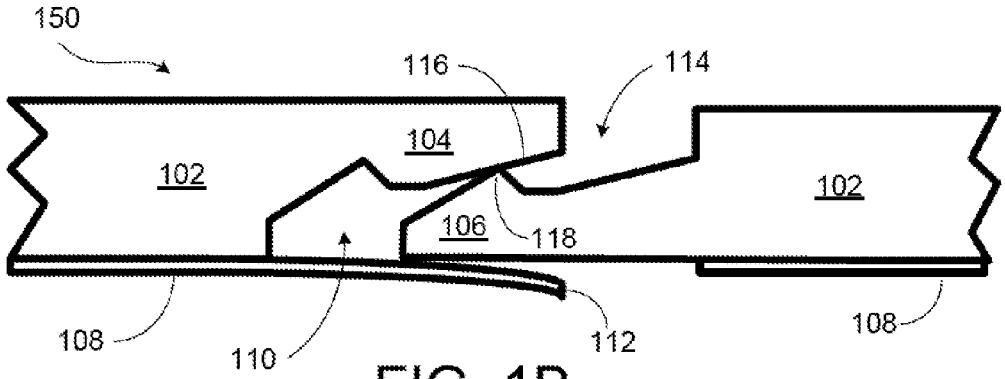
FIG. 1B illustrates an engagement between two adjacent floor boards.
Figure 2:
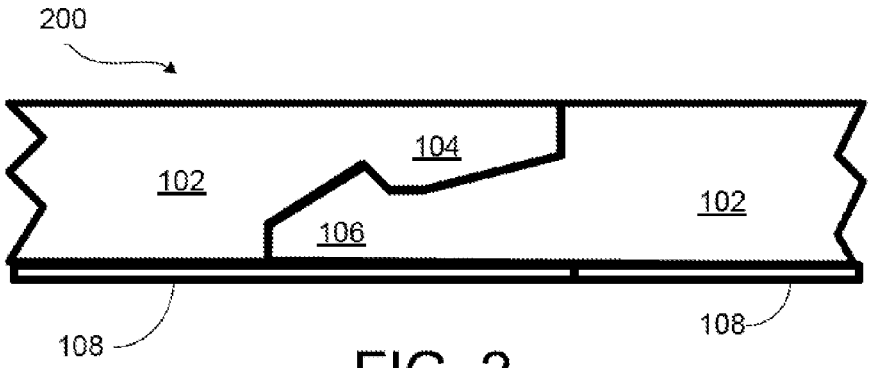
FIG. 2 illustrates two adjacent floor boards engaged.

FIG. 1B illustrates engagement of two adjacent floor boards 102. The tongue 106 of one floor board 102 slides into the receiving channel 110 of its neighboring floor board and the upper lip 104 engages the recessed region 114. The tongue 106 has a locking edge 118 and the locking edge 118 slides against the lower surface 116 of the upper lip 104. When the tongue 106 slides toward the locking channel 110, the tongue 106 forces against the lower lip 112. Since the lower lip 112 is flexible, the lower lip 112 bends downwardly. When the tongue 106 fully enters the locking channel 110, the lower lip 112 moves upwardly and returns to its original position as shown in FIG. 2. Because the lower lip 112 is flexible, the milling of the male locking apparatus and the female locking apparatus need not to be precise. The imperfect dimensions, or deformation of the dimension due to moisture change, can be "masked" by the flexible lower lip 112.

Figure 3:
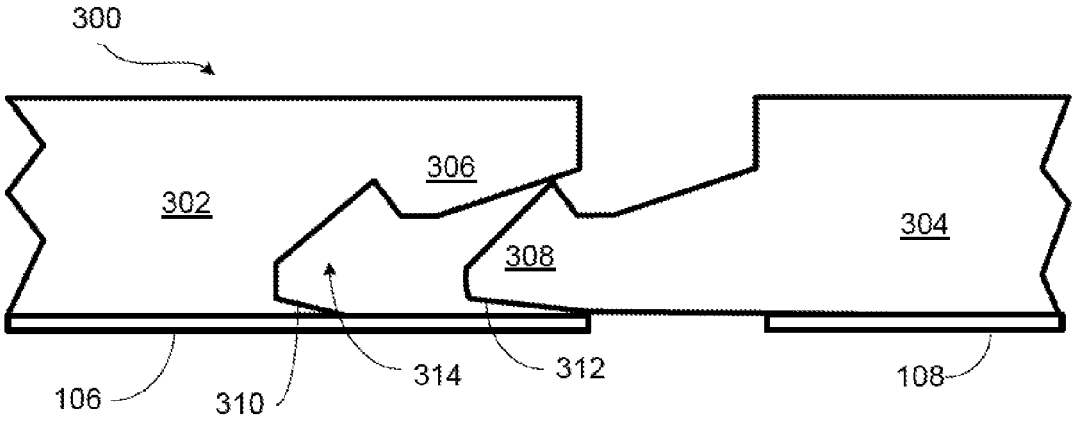
FIG. 3 illustrates engagement of two adjacent floor boards according to one alternative embodiment.

FIG. 2 illustrates the final position of the two adjacent floor boards 102 when fully engaged. The upper lip 104 is docked against the tongue 106, and the lower slate 108 returns to its resting position. Two adjacent floor boards 102 will not move away from each other when someone steps on the junction of two floor boards 102, i.e., a downward force is applied to the junction. As a matter of fact, the application of a downward force at the junction enforces the engagement of two adjacent floor boards. In case of large deformation of a joint (such as result from moisture change) could unlock and disengage the joint. However, with this lock mechanism, the stepping on the floor will repair the disengagement pull the two boards together, and strengthen the joint further. This enforcement can further seals the space between two floor boards and prevents water from seeping between the floor boards FIG. 3 illustrates engagement of two floor boards according to an alternative embodiment 300 of the present invention. Two adjacent floor boards are identical. One end of the floor board 304 has a male locking apparatus, which includes a tongue 308 with a lower slanted surface 312, and the opposite end of an adjacent floor board 302 has a female locking apparatus, which includes an upper lip 306, a channel 314, and a lower slate 108. The channel 314 has a upper slanted surface 310. The floor board 302 further has a lower slate 106 which is attached to the bottom of floor board 302 and forms an extension past the body of the board 302. The floor board 304 has a similar lower slate 108 and the male locking apparatus extends beyond the lower slate 108. The tongue 308 with the lower slanted surface 312 is built to interface with the upper slanted surface 310 on floor board 302. When a horizontal force is applied to floor board 304, the tongue 308 of the male locking apparatus slides under the upper lip 306 of the female locking apparatus of the floor board 302 and forces the lower slate 106 to bend downward. When the tongue 308 enters the channel 314, the lower slate 106 returns to its normal position and two adjacent floor boards 302, 304 are engaged as shown in FIG. 4.

Figure 4:
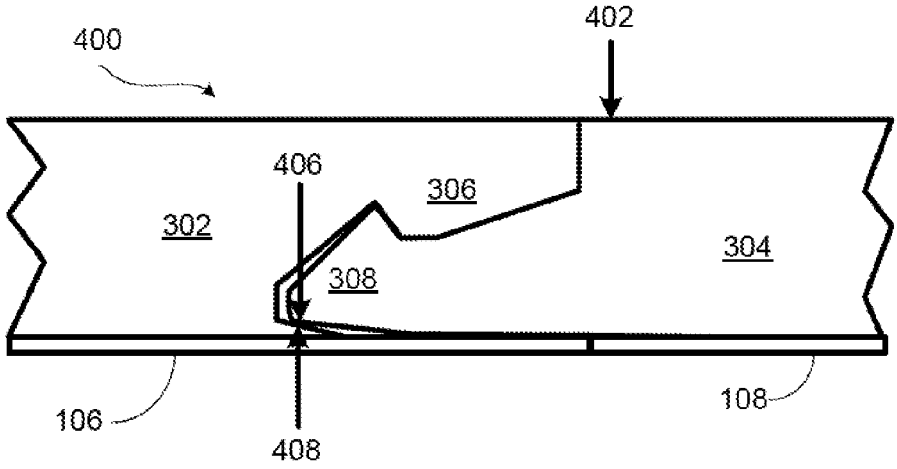
FIG. 4 illustrates a force decomposition after engagement of two floor boards.

The lower slanted surface 312 and the upper slanted surface 310 serve a special purpose as shown in FIG. 4. When a vertical force 402 is exerted on floor board 304, e.g. a human stepping on the floor board, the vertical force 402 causes a corresponding force 406 to be exerted by the tongue 308 on the upper slanted surface 310. The upper slanted surface 310, being rigid because it is part of the body of the floor board 302, does not bend or flex easily as the lower slate 106. The upper slanted surface 310 resists deformation, therefore it exerts an equal and opposite force 408 upwards on the tongue 308 which presses the tongue 308 against the upper lip 306. This helps secure the two floor board ends 302 and 304 in place without the need for precision milling and allows acceptance deformation of dimensions without unlocking.

Figure 5:
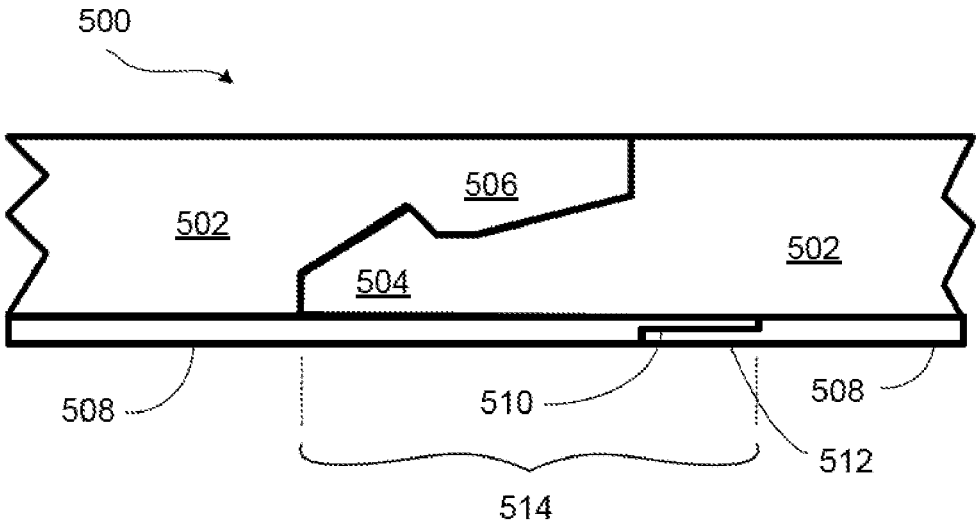
FIG. 5 illustrates two adjacent floor boards engaged according to one alternative embodiment of the invention.

FIG. 5 illustrates yet another alternative embodiment 500 of the invention. The floor board 502 has a male locking apparatus and a female locking apparatus as other embodiments. However, the floor board 502 has a modified lower slate 508. The lower lip 514 extends beyond the receiving channel and the tip of the lower lip 512 has an upper engagement portion 510. The other end of the lower slate 508 of the floor board 502 has a lower engagement portion 512. When two adjacent floor boards 52 are fitted together, the upper engagement portion 510 engages the lower engagement portion 512 and the lower engagement portion 512 provides support to the upper engagement portion 510. It will be seen from FIG. 6 that, upon application of a horizontal force to floor board 502 in the right hand side, the tongue 504 slides toward the channel 516 under the upper lip 506. As the tongue 504 slides under the upper lip 506, the upper engagement portion 510 engages and slides into a receiving groove 518 formed by the lower engagement portion 512 and the tongue 504. Because the tongue 504 moves slightly downwardly and the upper engagement portion 510 is engaged to the lower engagement portion 512, the lower lip 514 will flex downwardly. Because the lower engagement portion 512 is flexible, the lower engagement portion 512 will flex and not break. Although the figure shows the lower engagement portion 512 paired to the end of the floor board 502 on the right hand side with the tongue 504 and the upper engagement portion 510 paired to the end of the floor board 502 on the left hand side with the upper lip 506, it is evident that the positions of the upper engagement portion 510 and lower engagement portion 51 may be exchanged with no effect on the essence of the invention.

Figure 6:
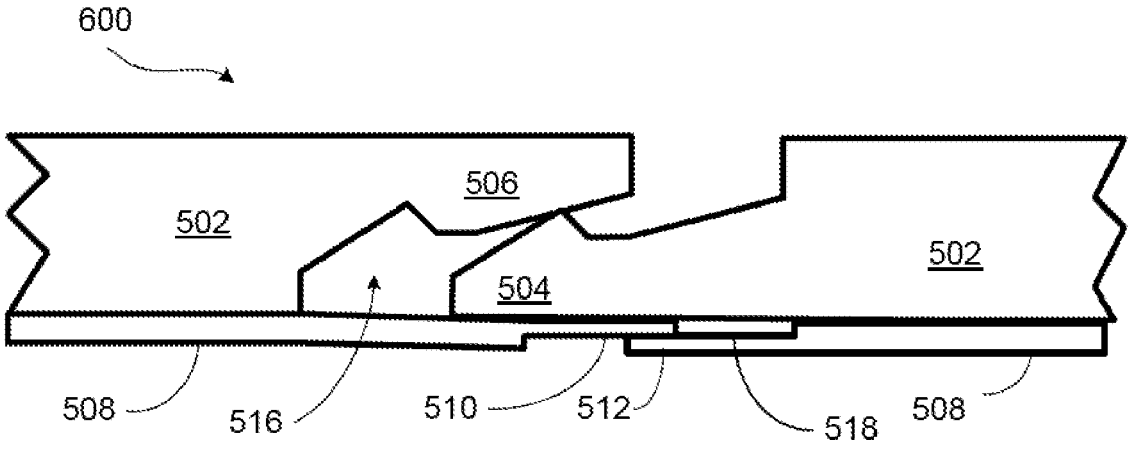
FIG. 6 illustrates engagement of two adjacent floor boards according to one alternative embodiment of the invention.

In the embodiment shown in FIGS. 5 and 6, the engagement of two adjacent floor boards is improved and provides even tighter joint between them. When a vertical downward force is applied to a floor board 502, the floor board 502 will not disengaged from its neighboring floor board even there is no upper slated surface 310 as shown in FIGS. 3 and 4. The upper engagement portion 510 and lower engagement portion 512 will provide additional support to the male locking apparatus and female locking apparatus. It is understood that the length of the lower slate 508 and lower lip 514 is not limited to the proportion shown in the figures.

Figure 7:
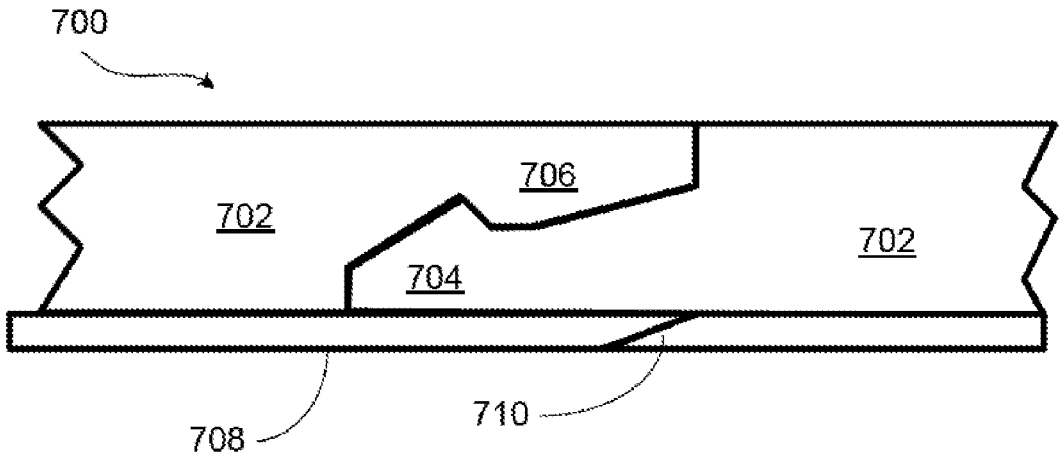
FIG. 7 depicts two adjacent floor boards engaged according to yet another alternative embodiment of the invention.

FIG. 7 illustrates yet another alternative embodiment 700 of the invention, where the flexible lower slate 708 is tapered with a smooth diagonal surface 710 on either end. The diagonal surface 710 of the lower slate 708 provides similar function of lower engagement portion 512 and upper engagement portion 510 and eases the engagement lower slates 708 from two adjacent floor boards 702. The floor board 702 rests its lower slate 708 on the top of the lower slate 708 of an adjacent floor board 702 and the tongue 704 fits into a channel formed by the upper lip 706 and the lower slate 708. A downward force (not shown) applied to the junction of the interface will enforce engagement of the floor boards 702 together and prevent seepage of water or debris into the junction.

Figure 8:
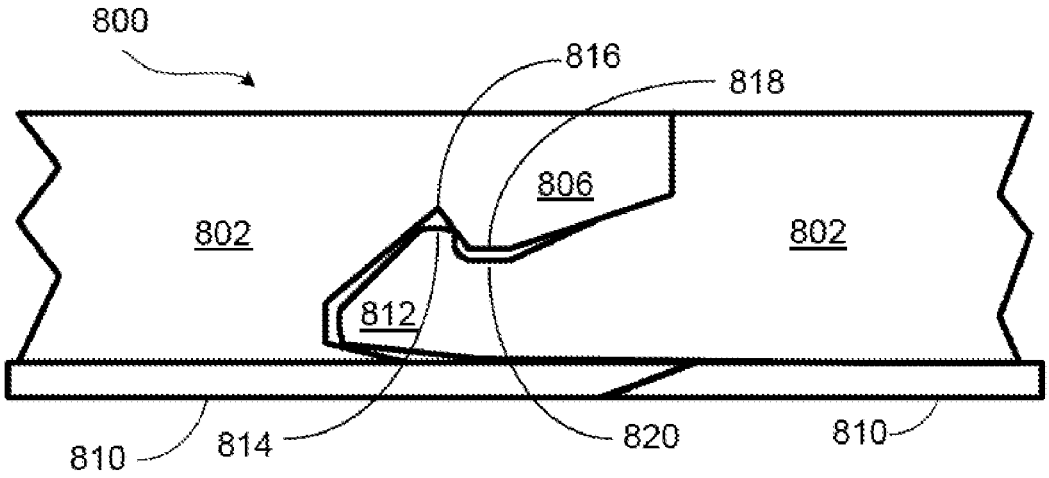
FIG. 8 depicts two adjacent floor boards engaged according to yet another alternative embodiment of the invention

FIG. 8 illustrates yet another alternative embodiment 800 of the invention. The male locking apparatus of the floor board 802 has a tongue 812 that has different shape from the tongues of previous embodiments. The tongue 812 has locking edge 814 that may be rounded instead of having a sharp edge as upper receiving area 816 on the upper lip 806. The tongue 812 has also a recessed region 820 that may be curved instead of straight edge lower receiving area 818. The embodiment 800 illustrates interface dimensions between two adjacent floor boards 802 need not to be precise. The boards 802 will remain locked in place against an applied downward force without the need for precision milling. The boards will also remain engaged despite small mechanical deformations caused by moisture, material stress release, humidity, temperature change, or other environmental factors.

Figure 9:
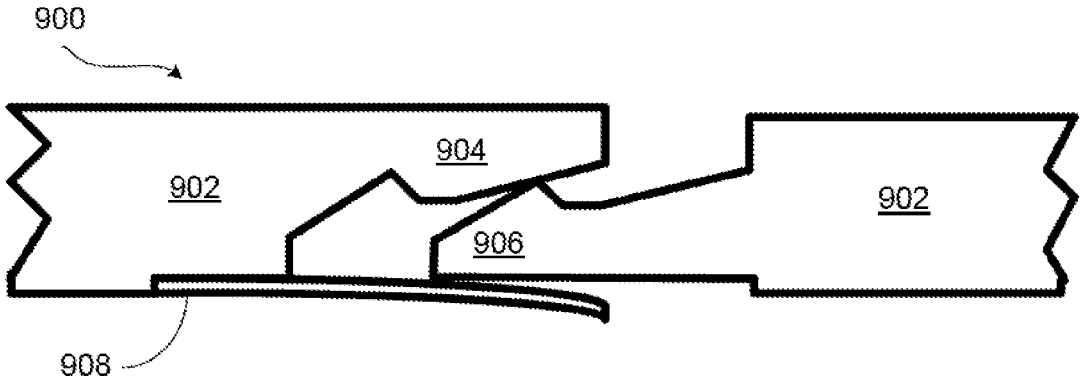
FIG. 9 depicts an embodiment of a floor board with different construction.
Figure 10:
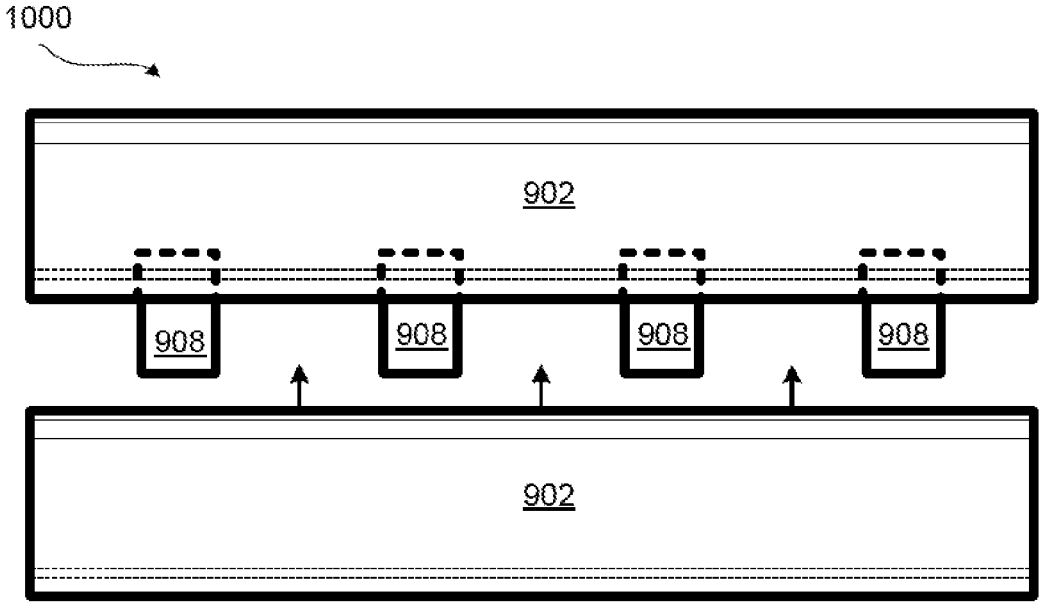
FIG. 10 is a top view of engagement of two floor boards of FIG. 9.

FIG. 9 illustrates yet another alternative embodiment 900 of the present invention. Instead of the lower lip 112 being part of the lower slate 108 as shown in FIG. 1A, the construction of the floor board can be made simpler as shown in FIG. 9. The body of the floor board 902 is one single piece that can be made from different materials, including composite, man-made multi-layer wood material. The lower slate 908 is a small piece material that can be attached to the body of the floor board 902 at different points. The male locking apparatus and female locking apparatus may extend to the entire length of the floor board 902, and the lower slate 908 are placed in separate and discrete locations as shown in the embodiment 1000 in FIG. 10.

Though the invention is described above using hardwood floor boards as examples, the invention can be easily applied to other uses, such as wall panels, wall tiles, external sidings, roof panels, ceiling panels, solar cell panels, and ceiling tiles. The flexible engaging mechanism can be used with boards, panels, and tiles of different materials, such as wood, particle boards, laminate material, plastic, metal, fiber glass, etc.

The terms and expressions which have been employed herein are used as terms of description and not of limitation, and there is no intention, in the use of such terms and expressions, of excluding any equivalents of the features shown and described (or portions thereof), and it is recognized that various modifications are possible within the scope of the claims and features shown in different figures may be combined. Other modifications, variations, and alternatives are also possible. Accordingly, the claims are intended to cover all such equivalents. Dimensions in the drawings here presented are not to the scale unless otherwise indicated.

What is claimed is:

1. A floor board comprising:

a top side;

a bottom side;

at least one lower slate attached to the bottom side, the at least one lower slate being substantially flat and having a length, a left end, the left end having a male locking device extending beyond the length of the at least one lower slate, the male locking device having a tongue with a locking edge;

a right end, the right end having a female locking device formed by an upper lip and a lower lip, the lower lip being formed by a portion of the at least one lower slate, the upper lip having a lower surface; and wherein the at least one lower slate being flexible and flexes downwardly when the locking edge of the male locking device slides against the lower surface of the upper lip of the female locking device of an adjacent floor board.

2. The floor board of claim 1, wherein the at least one lower slate runs continuously along a length of the floor board.

3. The floor board of claim 1, further comprising a plurality of lower slates and the plurality of lower slate being placed along a length of the floor board.

4. The floor board of claim 1, wherein the at least one lower slate being attached to the bottom side through nails.

5. The floor board of claim 1, wherein the at least one lower slate being attached to the bottom side through adhesive.

6. The floor board of claim 1, wherein the female locking device having a upper slanted surface.

7. The floor board of claim 1, wherein the male locking device having a lower slanted surface.

8. The floor board of claim 1, wherein the at least one lower slate being made from wood material.

9. The floor board of claim 1, wherein the at least one lower slate being made from laminate material.

10. The floor board of claim 1, wherein the at least one lower slate has two ends, each end having a diagonal surface.

11. The floor board of claim 1, wherein the locking edge of the male locking devices engages the upper lip of the female locking device of the adjacent floor board locking the floor board to the adjacent floor board.

12. A floor board comprising:

a body with a left side and a right side and a bottom side;

a lower slate, with a left side and a right side, attached to the bottom side of the body, the lower slate having a lower engagement portion on the left side of the lower slate and a upper engagement portion on the right side of the lower slate;

a male locking device formed on the left side of the body; and a female locking device formed on the right side of the body, wherein the male locking device of the floor board engages the female locking device of an adjacent floor board and the lower engagement portion of the lower slate of the floor board engages the upper engagement portion of the lower slate of an adjacent floor board.

13. The floor board of claim 12, wherein the lower engagement portion and the upper engagement portion are diagonal surfaces.

* * * * *